US009976818B2

(12) United States Patent
Andreatta

(10) Patent No.: US 9,976,818 B2
(45) Date of Patent: May 22, 2018

(54) COOLING TANK FOR RAILS

(71) Applicant: Danieli & C. Officine Meccaniche S.P.A., Buttrio (IT)

(72) Inventor: Daniele Andreatta, Borso Del Grappa (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 71 days.

(21) Appl. No.: 14/357,460

(22) PCT Filed: Nov. 12, 2012

(86) PCT No.: PCT/IB2012/056345

§ 371 (c)(1),
(2) Date: May 9, 2014

(87) PCT Pub. No.: WO2013/068998

PCT Pub. Date: May 16, 2013

(65) Prior Publication Data

US 2014/0311711 A1 Oct. 23, 2014

(30) Foreign Application Priority Data

Nov. 11, 2011 (IT) ..... MI2011A2052

(51) Int. Cl.
*F28F 9/007* (2006.01)
*C21D 9/04* (2006.01)
(Continued)

(52) U.S. Cl.
CPC ..... *F28F 9/007* (2013.01); *C21D 1/63* (2013.01); *C21D 1/64* (2013.01); *C21D 9/04* (2013.01);
(Continued)

(58) Field of Classification Search
CPC ..... C21D 11/005; C21D 1/63; C21D 1/64; C21D 2221/00; C21D 2221/01; C21D 9/04; F28F 9/007
(Continued)

(56) References Cited

U.S. PATENT DOCUMENTS 6,432,230 B1 8/2002 Kock et al.
2009/0200713 A1* 8/2009 Koeck ..... B21B 43/003 266/44

FOREIGN PATENT DOCUMENTS

GB 290182 7/1929
GB 451961 8/1936
(Continued)

*Primary Examiner* — Scott Kastler
*Assistant Examiner* — Michael Aboagye
(74) *Attorney, Agent, or Firm* — Stetina Brunda Garred & Brucker

(57) ABSTRACT

A cooling tank for the thermal treatment of a rail head provided with a structure comprising a first volume (2), adapted to be filled with a cooling fluid; a second volume (4), arranged above the first volume and communicating therewith, so that the fluid passes from the first to the second volume and the rail head to be thermally treated can be immersed therein; a partition plate (5) between first and second volume, provided with a single row of holes (6), preferably arranged at the center of the width of the second volume, for generating jets of cooling fluid from the first to the second volume; a pair of longitudinal bulkheads (7), arranged in said second volume perpendicular to the plate and symmetrically with respect to the single row of holes, adapted to direct the jets of fluid exiting from the holes vertically upwards.

18 Claims, 8 Drawing Sheets

(51) Int. Cl.
*C21D 11/00* (2006.01)
*C21D 1/63* (2006.01)
*C21D 1/64* (2006.01)

(52) U.S. Cl.
CPC ..... *C21D 11/005* (2013.01); *C21D 2221/00* (2013.01); *C21D 2221/01* (2013.01)

(58) Field of Classification Search
USPC ..... 266/112, 133, 44, 130, 132; 165/104.19
See application file for complete search history.

(56) References Cited

FOREIGN PATENT DOCUMENTS

| | | | | |
|---|---|---|---|---|
| GB | 619699 | * | 3/1949 | ..... C21D 9/04 |
| JP | 59222531 | | 12/1984 | |
| WO | WO 2010133666 | * | 11/2010 | ..... C21D 9/04 |
| WO | WO2010133666 A1 | | 11/2010 | |

* cited by examiner

COOLING TANK FOR RAILS

CROSS REFERENCE TO RELATED APPLICATIONS

The present application claims priority to PCT International Application No. PCT/IB2012/056345 filed on Nov. 12, 2012, which application claims priority to Italian Patent Application No. MI2011A002052 filed Nov. 11, 2011, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

Field of the Invention

The present invention relates to a cooling tank, in particular to a tank suitable for cooling rails in a thermal treatment plant of rail heads.

Background Art

Several solutions are known in the prior art for the thermal treatment of rolled rails, in particular aimed to obtain the hardening of the rail head.

Starting from a temperature higher than 600° C., rails are subjected to a quick cooling of the head either by the use of spray nozzles, which inject a cooling fluid (water, air or water mixed with air) on the rail head, or by the immersion of the head into a cooling tank containing a cooling liquid, for example water added with additive.

Compared to the solution with spray nozzles, the use of the tank allows to obtain a greater cooling uniformity, in the direction of the rail length, and higher cooling rates.

In order to further increase the thermal exchange inside the tank and thus speed up the treatment, some solutions of the prior art provide for jets of cooling liquid originating from holes located on the bottom of the tank and impinging the rail head immersed in the liquid: such jets increase the thermal exchange and accordingly the cooling rate.

Such a solution is described in document GB619699, which discloses a tank provided with three rows of holes on the bottom, wherefrom the cooling liquid exits, adapted to create jets of liquid directed towards the immersed rail head. However, the above document provides that the rail head to be treated rests on a support, which represents a hindrance for the liquid exiting from the holes and deviates it on the two sides of the rail head. As a result, the central zone of the rail head is not impinged by such jets and thus undergoes a non-uniform cooling.

Other solutions have been proposed to improve such cooling process, as disclosed for example in document JP63203724, which provide for supporting the rail by the bottom thereof so as to not have any hindrances between the jets and the immersed rail head and treat it as uniformly as possible.

In particular, JP63203724 provides for three separate jets, within the bath, directed onto the three faces of the rail head.

Another known solution is disclosed in document WO2010/133666A1 where a plurality of baskets occupies the upper part of the central volume of the tank, each basket comprising lower panels or deflectors and respective upper panels or deflectors. Lower and upper deflectors are reciprocally separated by a longitudinal element comprising a central plate provided with at least ten rows of nozzles and integrally fixed to two side plates. Said side plates are not coplanar with respect to the central drilled plate but are inclined downwards with respect to the plane defined by the central drilled plate by a predetermined angle, for example equal to 5÷15°. The lower deflectors are completely above the delivery manifold when the baskets are fully inserted into the tank modules. Together with the inner walls of the central volume, the lower deflectors define first compartments below the drilled central plate. At each of said first compartments there is provided a same number of calibrated holes, defining two opposite rows of nozzles respectively provided on two opposite sides of the underlying portion of the longitudinal stretches of the delivery manifold. At the junctions between the drilled central plate and non-drilled side plates, above the drilled central plate, there are provided curvilinear walls, convex with respect to the longitudinal center line plane of the module; and the upper deflectors, transversal to said curvilinear walls, together with said curvilinear walls, define second compartments above the drilled central plate.

A further known solution is disclosed in document US2009/200713A1 where two drilled plates are provided, with nozzles arranged on multiple rows which divide the cooling tank into three compartments, arranged one on top of the other.

However, in all these solutions of the prior art, at the exit of the nozzles, the jets of cooling liquid, going progressively up towards the rail, unavoidably tend to enlarge, loosing speed accordingly, and to flit about, i.e. to alternately direct rightwards or leftwards with respect to the hypothetical impact point, causing a non-symmetrical and non-uniform thermal transfer.

On the other hand, the rail head cannot be moved too close to the holes, located on the bottom of the tank, to preserve the treatment uniformity on the entire rail length and prevent the so-called "punctiform effect" which is due to the presence of a determined pitch between the holes: a rail too close to the holes is not uniformly treated along the longitudinal axis since the rail head zones, located perpendicularly above the holes, undergo a greater cooling than the stretches located at the pitch between two consecutive holes.

The need of providing a cooling tank that allows to overcome the above drawbacks is therefore felt.

SUMMARY OF THE INVENTION

The primary object of the present invention is to provide a cooling tank for the thermal treatment of the rail head which, by directing jets of cooling fluid, allows a particularly high cooling efficiency to be achieved with the same flow rate and other conditions.

Another object of the invention is to provide a cooling tank that, with the same efficiency, allows a high thermal exchange uniformity to be obtained on the entire rail length, being able to increase the distance of the rail head from the bottom of the tank, so as to limit or eliminate the punctiform effect of the jets.

Another object of the invention is to provide a cooling tank for rails that allows a wide range control of the rate at which the jets of cooling fluid arrive in the proximity of the rail head, thus controlling the cooling rate, increasing or decreasing it according to the needs and the treatments required by the rail.

The present invention therefore aims to achieve the above objects by providing a cooling tank for the thermal treatment of a rail head by immersion which, according to claim 1, defines a longitudinal axis and comprises a volume adapted to be filled with a cooling fluid in which the rail head to be thermally treated can be immersed, said volume having a bottom, the tank being characterized in that the bottom is provided with a single row of nozzles only, arranged along said longitudinal axis and parallel to a symmetry plane of said volume, in order to generate jets of cooling fluid in said volume, and in that at least one pair of substantially reciprocally parallel longitudinal bulkheads is provided, arranged in said volume substantially perpendicular to said bottom and symmetrically with respect to said single row of nozzles, configured to direct upwards the jets of cooling fluid exiting the nozzles.

With the introduction of the bulkheads it is advantageously possible to direct the jets of fluid and drastically limit the flitting of the same: the single jet of cooling fluid impinges the center of the rail head and splits into two parts that symmetrically lap the two sides of the head. It has thus been seen that the presence of the bulkheads leads to greater cooling uniformity on the immersed section.

Advantageously, with the bulkheads detached and lifted off the bottom of the tank, the fluid rate at the exit of the holes causes a suction of the surrounding fluid and a pulling of the fluid present at the sides of the holes or nozzles (ejector effect): a circular motion of the fluid is thus created at the sides of the bulkheads that is drawn from underneath the bulkheads and then proceeds aligned and with no flitting along a vertical direction, thanks to the presence of the bulkheads, towards the piece to be treated, to then continue on the sides of the same, cooling them. A part of the fluid then goes down again onto the bottom of the tank to be drawn again, passing underneath the bulkheads.

FIGS. 3*a*, 3*b* and 3*c* compare the rate vectors of the cooling fluid at operating speed in the case of a tank without bulkheads (FIG. 3*a*), in the case of a tank according to the invention provided with bulkheads resting on the bottom of the tank (FIG. 3*b*) and, finally, in the case of a tank according to the invention provided with bulkheads spaced away from the bottom of the tank (FIG. 3*c*).

From the comparison of FIGS. 3*a* and 3*b* it is readily seen that the addition of the bulkheads makes the cooling fluid flow more compact, combined and coherent, substantially directional. If in the tank there are no bulkheads (FIG. 3*a*), the jet of fluid enlarges and already loses its compactness halfway between the exit nozzle and the rail head that must be treated. In particular, the jet becomes larger and slower accordingly, and splits into two parts even before reaching the center of the rail head.

On the other hand, FIG. 3*c* shows how the lifted bulkheads allow an even more stable and concentrated upward jet to be obtained.

The gap between the bulkheads and the volume bottom allows, with the same rate of the jets exiting the holes, the involvement of a larger volume of cooling fluid and, thus, the achievement of high jet rates. High cooling rates may be achieved in this way, with the same flow rate and other conditions, without having to intervene on the chemical composition of the cooling fluid. This leads to a higher cooling efficiency up to 50%.

The presence of the bulkheads, either attached to or detached from the bottom of the tank, further allows the punctiform effect of the jets to be reduced on the rail length since it allows the distance between the rail head and the holes to be increased, with the same treatment efficiency. In fact, with the bulkheads it is possible to increase such distance up to completely eliminate the punctiform effect, thus obtaining the maximum longitudinal uniformity, still ensuring an adequate cooling efficiency.

There is a continuous change of the liquid into the tank which, overflowing from the top of the same, is collected into two side volumes.

Thanks to the present invention, the efficacy and flexibility of the thermal treatment process is increased since the tank allows even higher cooling fluid flow rates to be used. In fact, if the flow rate is increased without the use of bulkheads, the jets are characterized by a particularly chaotic and not very orderly movement and move away from the "working" zones, limiting the heat removal from the rail head. On the contrary, if the bulkheads are provided, even increasing the flow rate, the jet flow remains directional and is directed exactly towards the zone wherefrom heat must be removed.

Thanks to the possibility of using higher flow rates, it is possible to achieve higher cooling rates, bringing an absolute increase in the cooling capacity to over 50%. In this way, the operating range of the tank is increased from 1 to 20° C./sec, preferably from 1.5 to 15° C./sec without having to modify or replace the type or concentration of hardening solution used. This leads to a high operating flexibility of the tank, with considerable advantages for the end user in terms of management (storage, filling, disposal) of the hardening solution according to the type of product to be treated.

The distance between the two bulkheads affects the treatment efficiency: increasing the distance between the two bulkheads, the jet rate decreases, accordingly dropping the cooling rate; the contrary happens if said distance is decreased.

An advantageous variant of the cooling tank of the invention provides for a system for adjusting the bulkhead position (either manual or automatic) in order to adjust said distance between the two bulkheads and/or said gap from the bottom of the tank when provided, so as to change the cooling rate without modifying the cooling fluid flow rate.

The cooling tank according to the invention has the following advantages:

- the flitting of the jets of cooling fluid exiting the holes is drastically reduced;
- the fluid jet can be directed towards the center of the rail head;
- a symmetrical treatment is obtained with respect to the symmetry plane of the rail cross section;
- the punctiform effect of the jets is reduced, thus obtaining a more uniform treatment along the longitudinal extension of the rail;
- higher cooling rates are achieved with the same flow rate (efficiency increased by 50%);
- the flow rate may be increased keeping the directionality of the fluid jets (higher efficacy);
- particularly high cooling rates can be reached without modifying the composition of the cooling fluid which may generally be water, oil or aqueous solutions of salts and/or polymers, significantly increasing the operating flexibility of the tank.

The dependent claims describe preferred embodiments of the invention.

BRIEF DESCRIPTION OF THE DRAWINGS

Further features and advantages of the invention will appear more clearly from the detailed description of preferred but non exclusive embodiments of a cooling tank, illustrated by way of a non-limiting example with the aid of the accompanying drawing tables, wherein.

The same reference numerals in the figures identify the same elements or components.

DETAILED DESCRIPTION OF THE INVENTION

Figure 1:
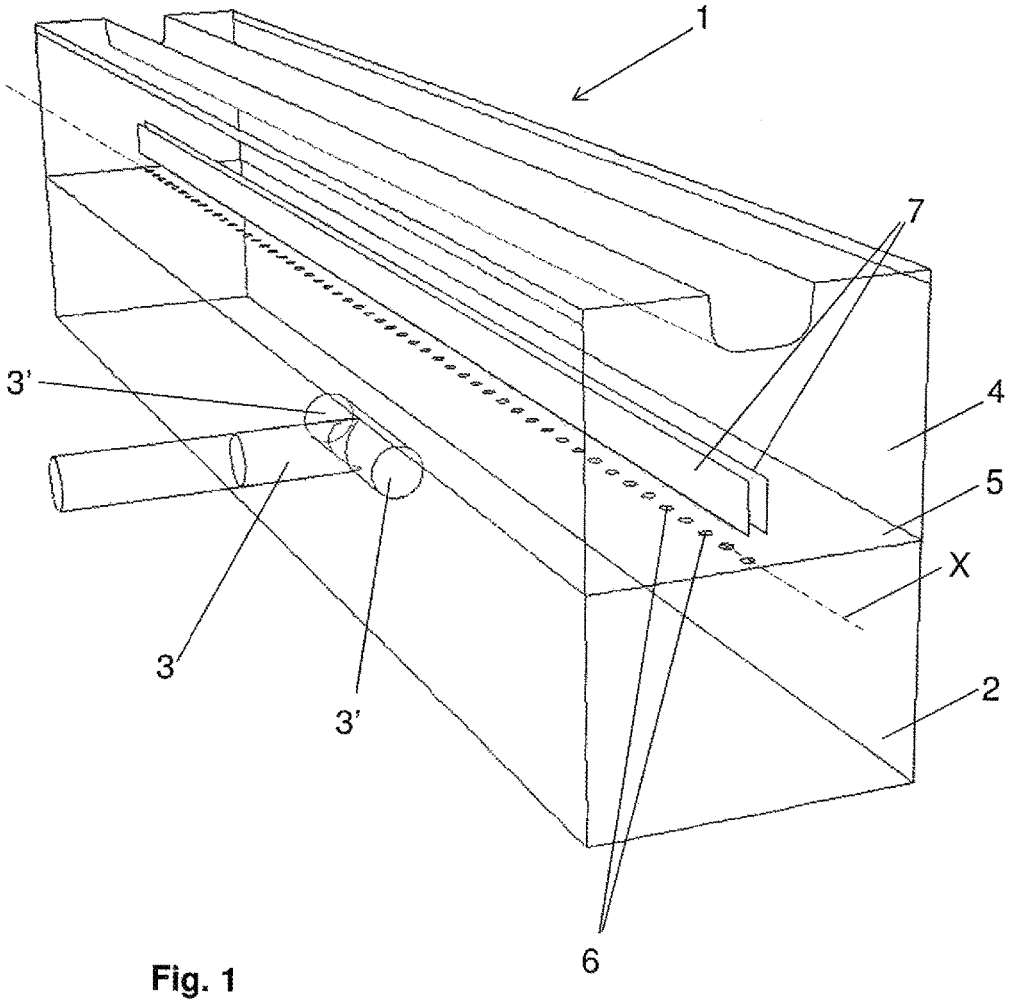
FIG. 1 shows a perspective view of a module of the cooling tank according to the invention.

With reference to FIGS. 1 and 2, there is shown a preferred embodiment of a cooling tank for the thermal treatment of the rail head, object of the present invention.

The tank is provided with a structure comprising:

- a lower volume 2, adapted to be filled with a cooling fluid;
- an upper volume 4, arranged above said lower volume 2 and communicating therewith so that the cooling fluid can move from the lower volume 2 to the upper volume 4, said upper volume 4 having a vertical symmetry plane and having the upper end open for immersing the rail head to be thermally treated;
- a partition plate between lower volume 2 and upper volume 4, defining the bottom 5 of the volume 4, provided with a single row of holes or nozzles 6 which generate vertical jets of cooling fluid, directed upwards, from the lower volume to the upper one;
- a pair of longitudinal bulkheads 7, arranged in the upper volume 4 perpendicular to the partition plate and symmetrically with respect to said single row of nozzles 6, adapted to direct the jets of cooling fluid exiting the nozzles 6.

Preferably but not necessarily the longitudinal axis X, wherealong holes 6 are arranged, lies on the symmetry plane of the upper volume 4 of the tank.

Advantageously, the longitudinal bulkheads 7 and the single row of nozzles 6 extend along the entire longitudinal extension or length of the tank.

In order to obtain an optimal cooling, rail 10 to be treated is at least partly immersed with the head 10' thereof into the upper volume 4, arranging the rail 10 with its symmetry plane arranged vertically and coincident with the symmetry plane. In this way, the jets of cooling fluid, directed centrally with respect to the tank width, are also directed towards the center of the rail head so that there is treatment symmetry.

The lower volume 2 is the so-called delivery volume whereas the upper volume 4 is the so-called cooling volume where the thermal treatments of the rail are carried out. The two volumes 2 and 4 are put in communication through the holes 6, all having a same diameter "d", wherethrough the cooling fluid is pushed from the lower volume to the upper one. The axis of holes or nozzles 6 is perpendicular to the partition plate and parallel to bulkheads 7.

Advantageously, the diameter d of holes 6 is about 6-12 mm, preferably equal to 10 mm, whereas the pitch between the holes is about 1.5-5 times the diameter of the holes, preferably 3 times the diameter of the holes.

The partition plate, defining the bottom 5 of the volume 4, is arranged perpendicular to the side walls of the tank. The lower volume 2 and the upper volume 4 preferably have the same width B and a reciprocally different height ($A \neq C$ in FIGS. 2*a* and 2*b*). However, an alternative variant may provide for a same height for both volumes 2, 4.

Figure 2A:
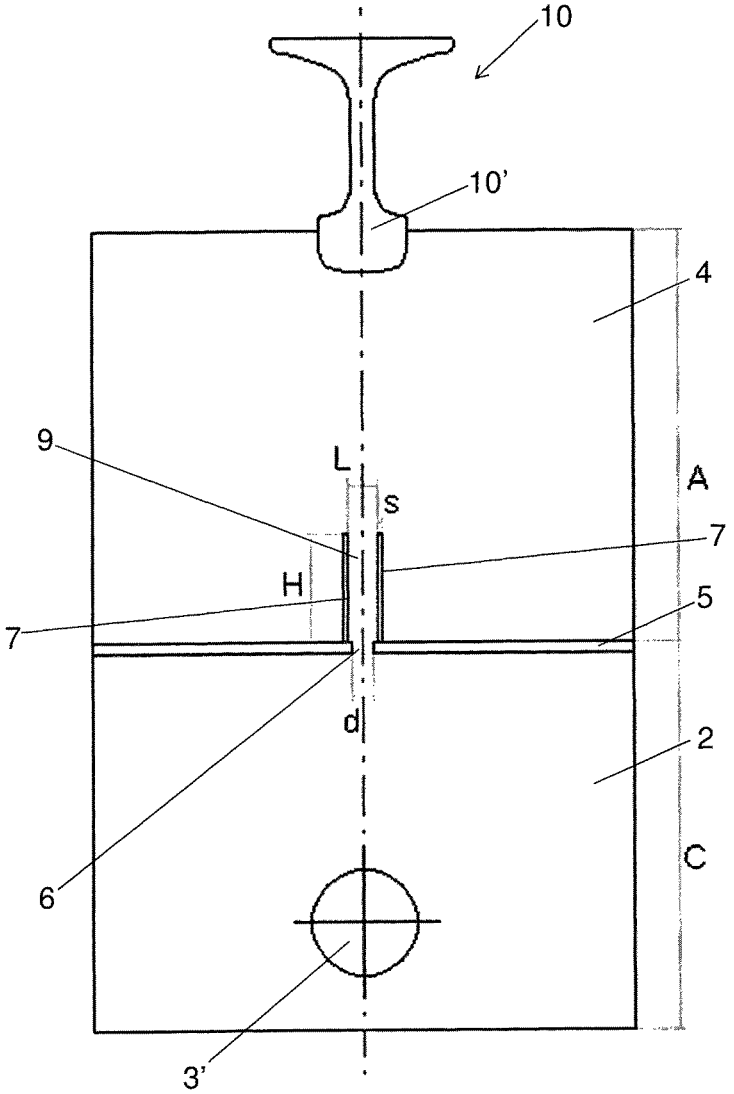
FIG. 2*a* shows a schematic section view of a first embodiment of the tank according to the invention.
Figure 2B:
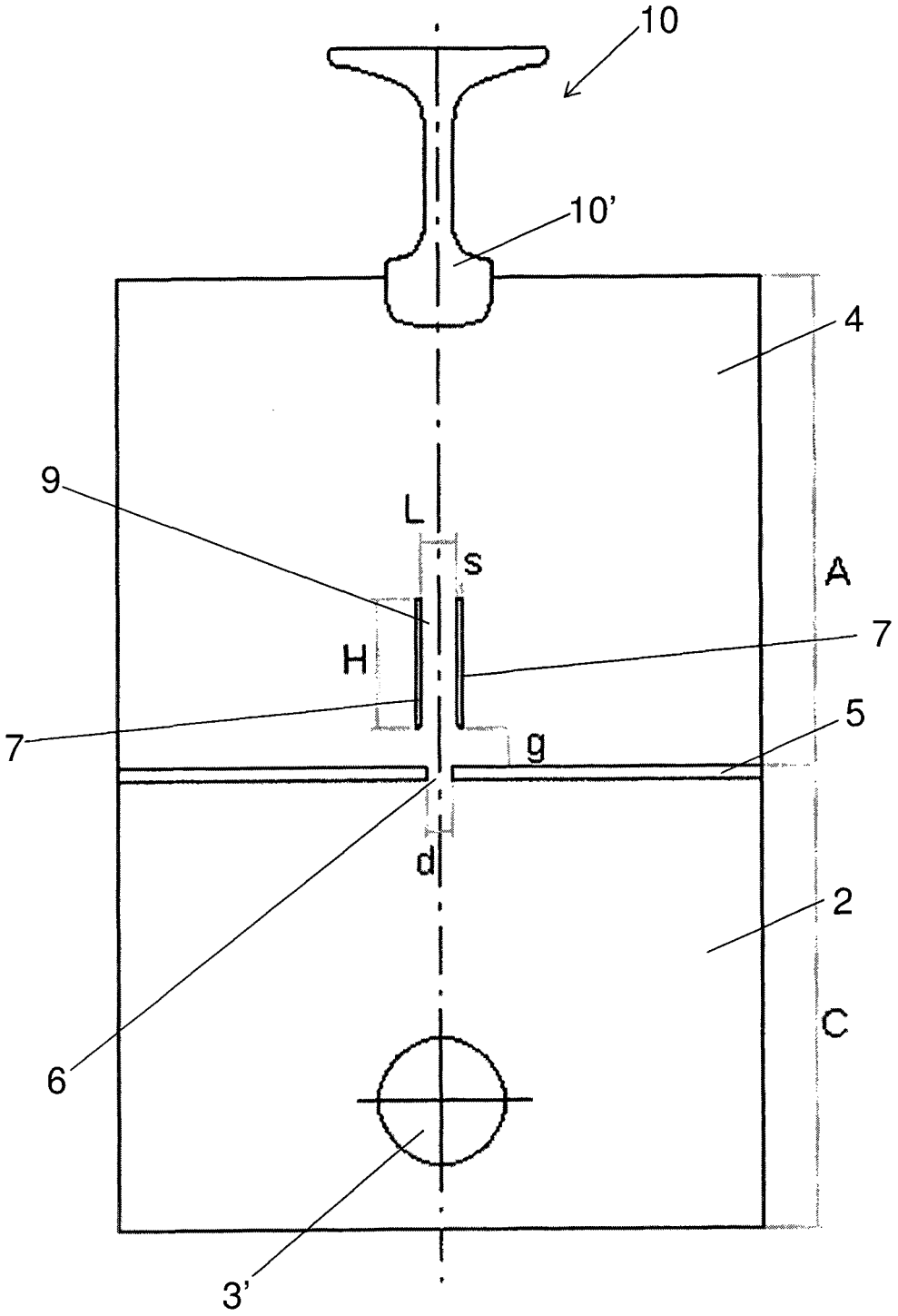
FIG. 2*b* shows a schematic section view of a second embodiment of the tank according to the invention.
Figure 3A:
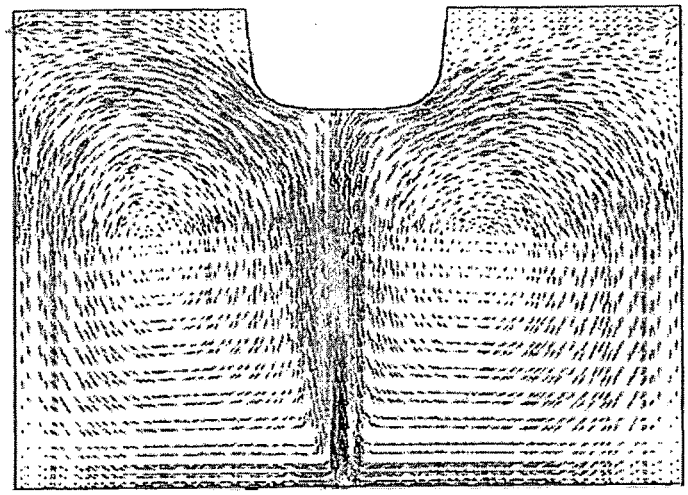
FIG. 3*a* shows the rate vectors of the cooling fluid, at operating speed, in the case of a tank without bulkheads.
Figure 3B:
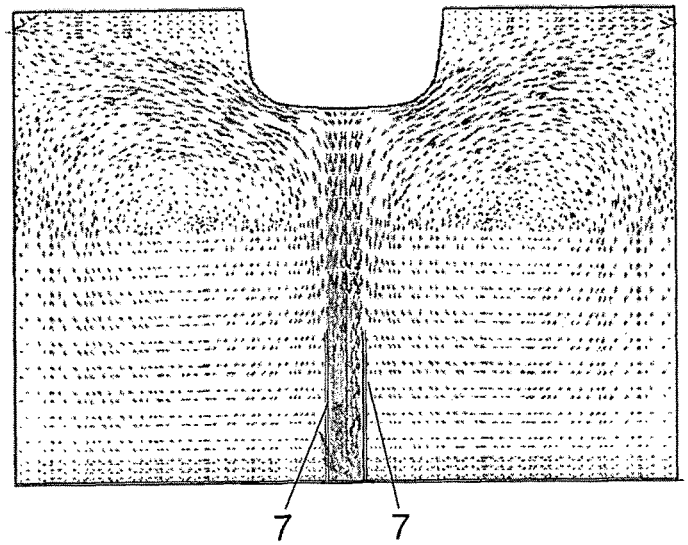
FIG. 3*b* shows the rate vectors of the cooling fluid, at operating speed, in the case of the tank of FIG. 2*a;*
Figure 3C:
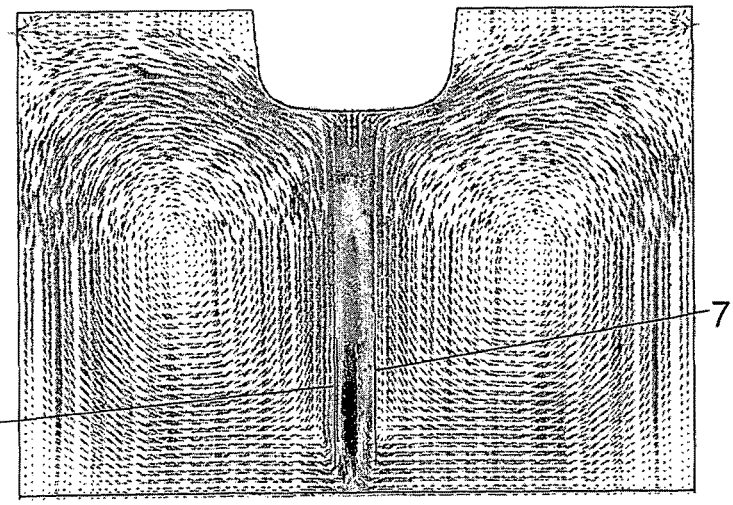
FIG. 3*c* shows the rate vectors of the cooling fluid, at operating speed, in the case of the tank of FIG. 2*b;*

With reference to FIGS. 2*a* and 2*b*, the distance "L" between the two bulkheads 7 preferably has a minimum value equal to diameter d of the holes and, in order not to lose the positive effect of the presence of the bulkheads and therefore not to reduce the rate of the jet of fluid exiting holes 6, a maximum value equal to twice the diameter of holes 6. Preferably, the distance "L" is larger than the diameter "d" of holes 6 by about 4-6 mm.

Thickness "s" of the bulkheads 7, preferably (but not necessarily) made of a metal material, advantageously is as small as possible inasmuch it is possible to ensure an adequate sturdiness and stiffness of the bulkheads, for example equal to about 5 mm.

Height H of the bulkheads 7 cannot be too short as it must allow the jet of fluid to be channeled by a sufficiently long path so that it reaches the rail head to be treated without flitting. Preferably, height H is not shorter than twice distance "L" between the bulkheads ($H \geq 2L$); even more preferably, it is equal to four-five times distance "L" between the bulkheads.

In a first advantageous variant of the tank of the invention, illustrated in FIG. 2*a*, the longitudinal bulkheads 7 rest on the partition plate 5, for example welded to said plate by the entire longitudinal extension or length thereof.

On the other hand, in a second, even more advantageous variant of the tank of the invention, shown in FIG. 2*b*, a distance or gap "G" is provided between the lower end of the bulkheads 7 and the bottom of the upper volume 4 consisting of the partition plate 5. Such gap "G" cannot be too large since, if the jet of cooling liquid was not restrained, it would proceed enlarging with respect to the axis of holes 6 and would hit against the lower part of the bulkheads 7, drastically losing speed and risking not to be channeled into the longitudinal slit or channel 9 defined by the reciprocally parallel bulkheads 7.

Figure 7:
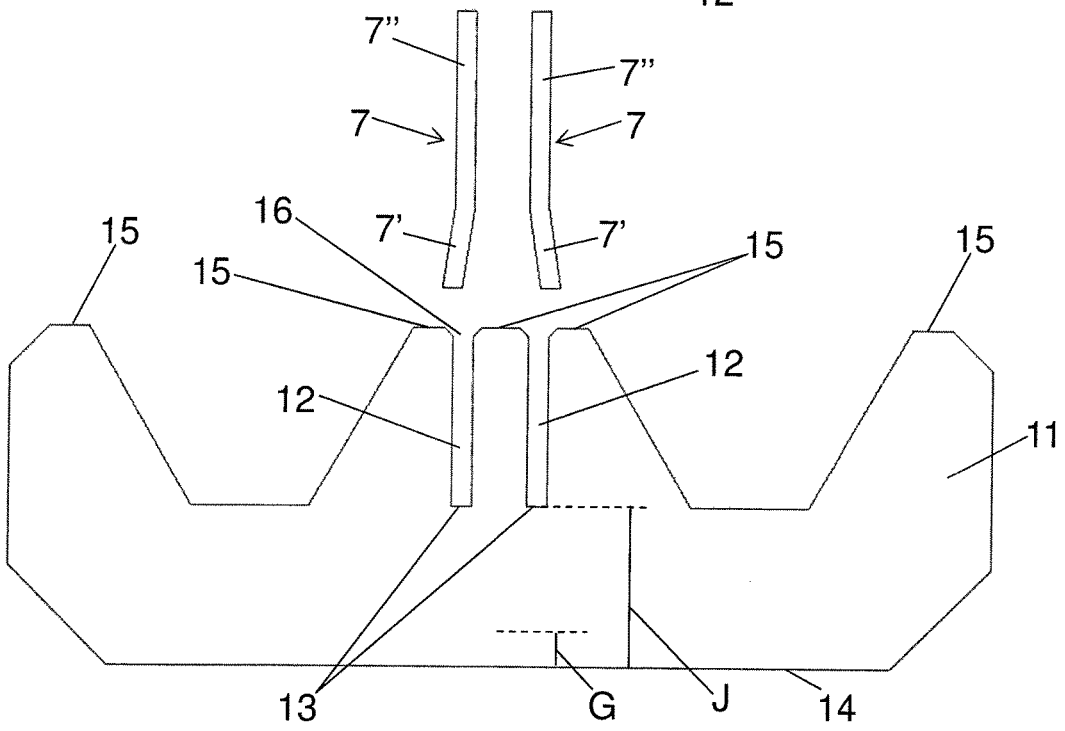
FIG. 7 shows a front view of the components of FIG. 6.

Advantageously, the distance or gap "G" is comprised in the range $0 \leq G \leq 1.5$ L. If a distance G other than zero is provided between the lower end of the bulkheads 7 and the partition plate 5, the lower ends of said bulkheads are advantageously chamfered so as to facilitate the conveying of the jet of cooling fluid in the longitudinal slit 9. An alternative variant (not shown) provides that the lower ends of the longitudinal bulkheads 7 comprise an end stretch 7' bent outwards (see bulkheads 7 in FIG. 7), inclined by an angle other than zero with respect to body 7" of the bulkhead and to the symmetry plane of the volume 4. Preferably, the inclination angle of the end stretches 7' is less than 10°, preferably comprised in the range between 1 and 8°. Such end stretch 7' may have a height equal to about $1/3H \div 1/4H$. This variant is particularly useful if the distance between the bulkheads 7 and the partition plate 5 is significant, as it allows the fluid flow exiting nozzles 6 to be prevented from hitting the lower end of bulkheads 7 and allows the fluid flow to be received and centrally conveyed into the longitudinal slit 9.

A further embodiment of the cooling tank of the invention provides for adjustment means for adjusting the bulkhead position (either manual or automatic), for adjusting the distance L between the two bulkheads and/or the gap G from the bottom of the tank when provided, so as to change the cooling rate without modifying the cooling fluid flow rate.

In a preferred embodiment, such adjustment means comprise a plurality of support elements 11, in jargon referred to as supporting legs.

Figure 4A:
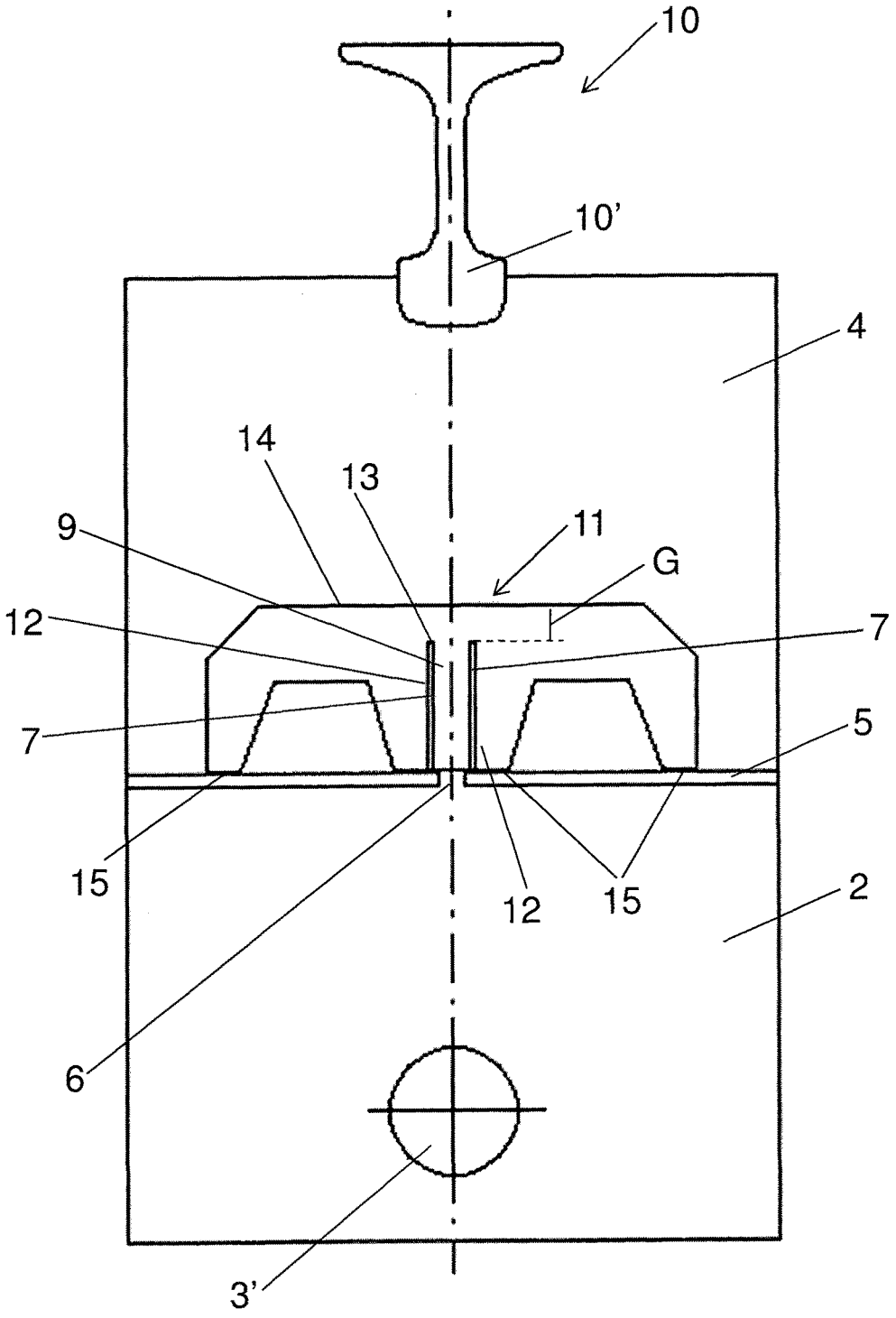
FIG. 4*a* shows a schematic section view of a variant of the tank of FIG. 2*a;*
Figure 4B:
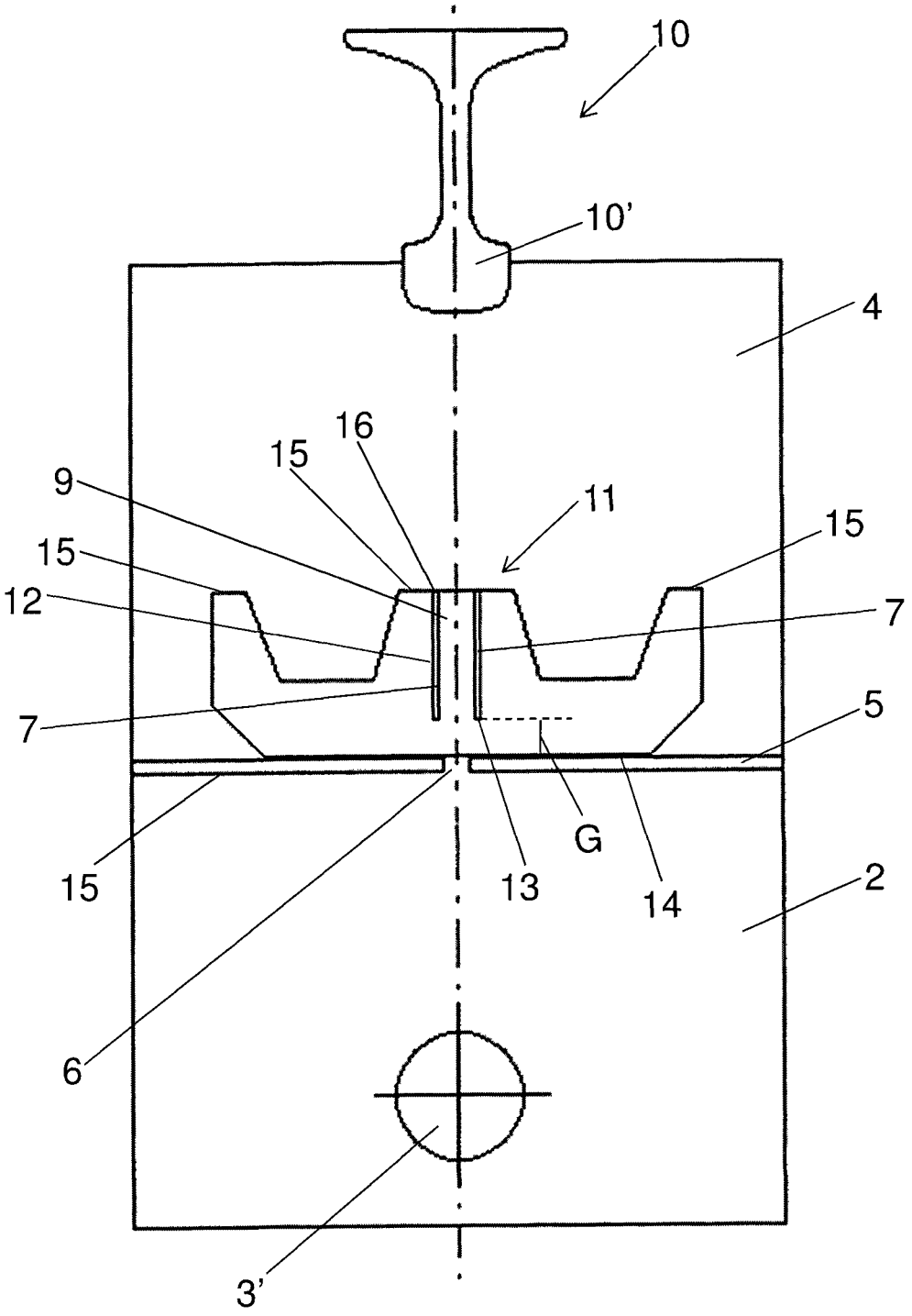
FIG. 4*b* shows a schematic section view of a variant of the tank of FIG. 2*b;*

In a first variant, illustrated in FIG. 4*a* or 4*b*, each substantially flat support element 11 is provided with two slits or notches 12 having a shape complementary to the shape of the rectangular transversal section of the two longitudinal bulkheads 7. The two bulkheads 7 are therefore entirely inserted into slits 12 of the plurality of support elements 11 and are integrally fixed to said support elements 11, for example by welding.

Advantageously, the dimensions of the support elements 11 and of the slits 12 are designed so as to allow the bulkheads 7 to be positioned at two predetermined distances from the bottom of the volume 4. The related figures show an example wherein the two predetermined distances whereat bulkheads 7 may be positioned with respect to the bottom of the volume 4 are G and 0 (zero). The closed inner end 13 of the slits 12 is made at a distance equal to the distance G from a first base surface 14 of the support elements 11. In this way, a first end of the bulkheads 7 is at distance G from the first base surface 14. The open outer end 16 of the slits 12, on the other hand, is provided at the same height as one or more second base surfaces 15 of the support elements 11, parallel to the first base surface 14. In this way, making slit 12 with a height shorter than or equal to the height H of the bulkheads 7, a second end of the bulkheads 7 is at the most at a null distance from the second base surface(s) 15.

Figure 6:
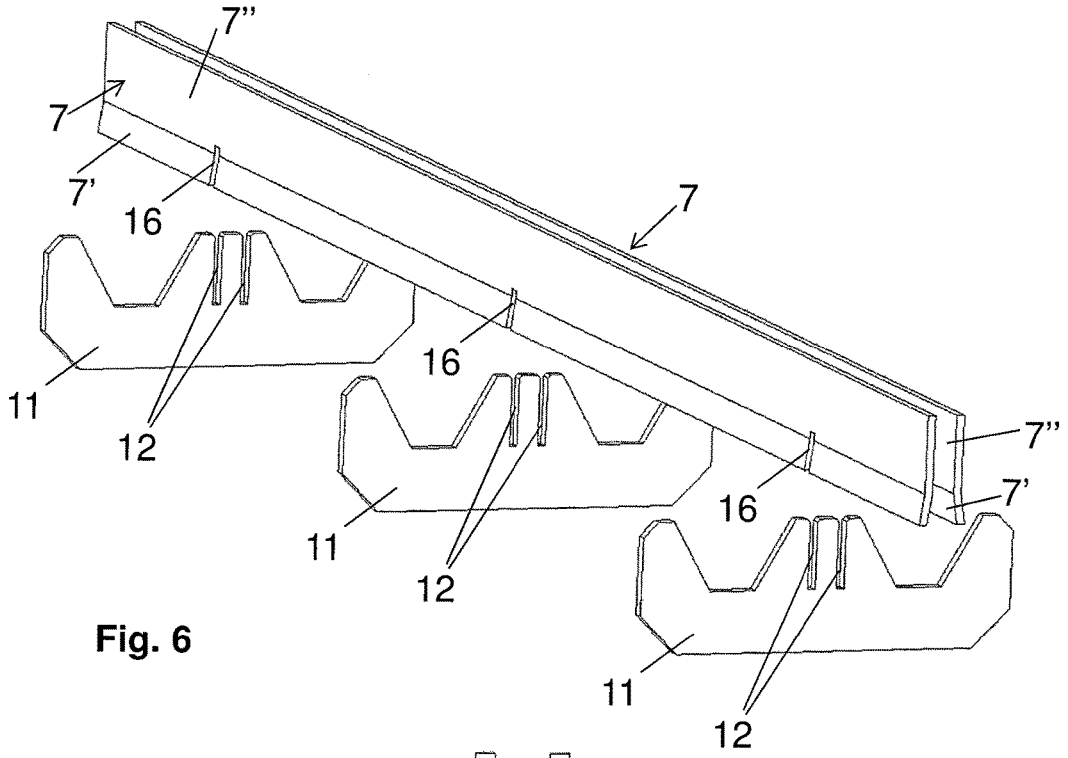
FIG. 6 shows an exploded view of the components of FIG. 5*b;*

A second variant, not shown, may provide for making slit 12 with a higher height than height H of the bulkheads 7, in any case keeping the same height as elements 11 as in FIG. 4; in this way, when the bulkhead is totally inserted in the respective slit, the second end of the bulkheads 7 is at a distance G' (advantageously shorter than G) from the second base surfaces 15. In this latter variant, the support elements 11 are made so that both the two positions thereof, indicated in the Figures, allow the bulkheads to be arranged at a gap other than zero from the partition plate 5 or bottom of the tank. In this case, along the longitudinal axis X, both longitudinal ends of the bulkheads 7, having respective central longitudinal bodies reciprocally parallel and each defining a plane perpendicular to the partition plate 5, may optionally be inclined outwards by an angle other than zero with respect to the bulkhead body and to the symmetry plane of the volume 4. Preferably, the inclination angle of the lower and upper end stretches is less than 10°, preferably in the range between 1 and 8°. The sum of the heights of such lower and upper end stretches may for example be equal to about 1/3H÷1/4H, where H is the bulkhead height. Advantageously, the bulkheads 7 are provided with a plurality of slits or notches (such as for example the slits 16 shown in FIG. 6), made at the connection points of the bulkheads 7 with the support elements 11, i.e. at the two slits or notches 12 provided in each one of the support elements 11. The slits on the bulkheads are made along the entire height of the lower and upper end stretches and optionally also in a part of the body of the bulkhead 7 defining a plane perpendicular to the partition plate 5.

Figure 5A:
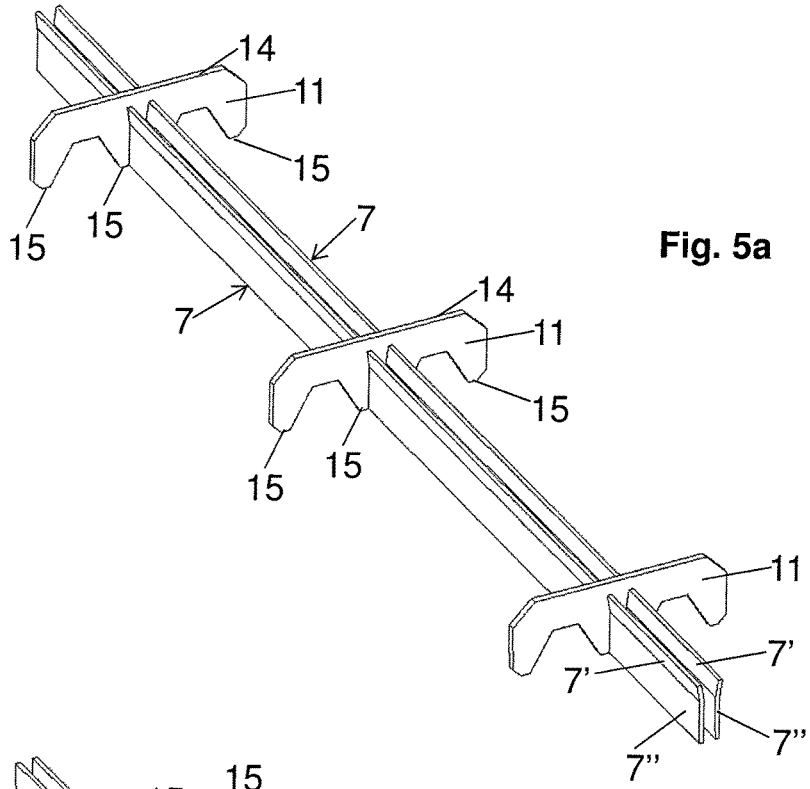
FIG. 5*a* shows a perspective view of some components of the tank according to the invention in a first operating position.

In a third variant, shown in FIG. 5*a* o 5*b*-7, each substantially flat support element 11 is provided with two slits or notches 12 having a shape complementary to a part of the transversal section of the two longitudinal bulkheads 7. The longitudinal bulkheads 7, reciprocally parallel and each defining a plane perpendicular to the partition plate 5, comprise at least one end stretch 7' bent outwards, inclined by an angle other than zero with respect to the bulkhead body 7", defining said perpendicular plane, and to the symmetry plane of the volume 4. Preferably, the inclination angle of the end stretches 7' is less than 10°, preferably in the range between 1 and 8°. Such end stretch 7' may have a height equal to about 1/3H÷1/4H.

Advantageously, the bulkheads 7 are provided with a plurality of slits or notches 16 made at the connection points of the bulkheads 7 with the support elements 11, i.e. at the two slits or notches 12 provided in each one of the support elements 11. Slits 16 are made along the entire height of the end stretches 7' and optionally also in a part of the body 7" of the bulkhead 7 defining a plane perpendicular to the partition plate 5. The two bulkheads 7 are inserted in slits 12 of the plurality of the support elements 11 and are integrally fixed to said support elements 11, for example by welding. The dimensions of the support elements 11 and of the slits 12 are designed so as to allow the bulkheads 7 to be positioned at two predetermined distances from the bottom of the volume 4. The closed inner end 13 (FIG. 7) of the slits 12 is made at a distance equal to a distance J>G from a first base surface 14 of the support elements 11. A first end of the bulkheads 7, in particular the end stretch 7', when they are totally inserted into slits 12, is at distance G from the first base surface 14. On the other hand, the open outer end 16 of the slits 12 is provided at the same height as one or more second base surfaces 15 of the support elements 11, parallel to the first base surface 14. A second end of the bulkheads 7, when totally inserted into slits 12, is at a null distance from the second base surface(s) 15.

Figure 5B:
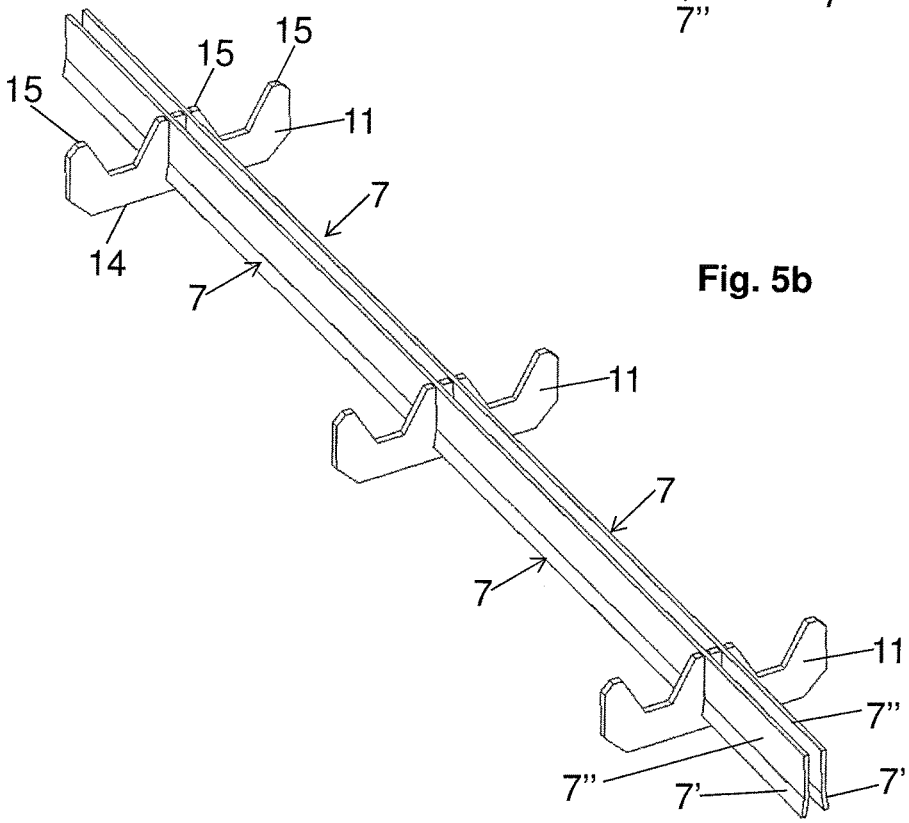
FIG. 5*b* shows a perspective view of some components of the tank according to the invention in a second operating position.

In the variants described above, the support elements 11 are arranged reciprocally parallel and orthogonal to the symmetry plane of the volume 4, and are regularly positioned along the bulkheads 7 and, thus, along the volume 4 of the tank. The distance between one support element and the next one is for example equal to about 500 mm. By arranging the support elements 11 and the bulkheads 7, welded thereto, with the second base surfaces 15 resting on the partition plate 5, i.e. on the bottom of volume 4, as shown in FIG. 4*a* or 5*a*, the longitudinal bulkheads 7 rest on the partition plate 5. On the other hand, by arranging the support elements 11 and the bulkheads 7, welded thereto, with the first base surface 14 resting on the partition plate 5, i.e. on the bottom of the volume 4, as shown in FIG. 4*b* or 5*b*, the longitudinal bulkheads 7 are positioned at a distance or gap "G" from the bottom of the upper volume 4 consisting of the partition plate 5. In order to switch from the position of FIG. 4*a* or 5*a* to the position of FIG. 4*b* or 5*b* it is simply possible to rotate the monolithic group, consisting of the bulkheads 7 and of the support elements 11, by 180°.

On the side of the upper volume 4 of the cooling tank there are provided respective side volumes (not shown) where the cooling fluid overflowing from the top of said upper volume 4 is collected. The two side volumes are provided with discharge tubes along the extension thereof. The cooling fluid already used for the thermal treatment of the rail flows, through the discharge tubes, into a recirculation circuit of the cooling fluid.

The cooling tank may advantageously consist of a plurality of longitudinal modules 1, reciprocally connected by flanges or other suitable connecting means so as to form a single element. The longitudinal extension and the number of such modules 1 are such as to define a total length of the cooling tank longer than the length of the rail to be thermally treated by immersion of the head into said tank. A variant is provided with sliding blocks for sliding the modules in a longitudinal direction for allowing any thermal expansion of the tank. Only the central module or modules are fixed without possibility of movement.

Advantageously, modules 1 may be fed through a cooling fluid delivery circuit which is provided with symmetric branches, in a number equal to a power of two, and thus a uniform distribution of the rate among the modules.

Each module 1 is provided with a fluid inlet conduit arranged laterally and centrally with respect to the longitudinal extension of the same module. Such inlet conduit is connected to a delivery manifold 3 provided in the lower volume 2 of each module 1. Such delivery manifold 3, downstream of a first stretch defining an axis perpendicular to the longitudinal axis of the tank, is provided with a bifurcation with two longitudinal stretches 3' parallel to the symmetry plane of the upper volume of the tank. The two longitudinal stretches 3' may be positioned exactly below the vertical of the holes 6 or staggered with respect to the row of holes 6 by a distance equal, for example, to the conduit diameter.

Inlet conduit and delivery manifold 3 may be made as a single piece. The delivery manifold 3, comprising the two longitudinal stretches 3', is positioned in the lower part of the lower volume 2 of the tank.

By suitably selecting the section of the delivery manifold 3 and of the respective longitudinal stretches 3' as well as the number and dimensions of the holes 6, a substantially equal distribution of the rates exiting said holes is obtained on the entire longitudinal development of the tank, allowing a flow uniformity and, thus, a thermal treatment uniformity.

The cooling fluid continuously enters the delivery manifold 3, and thus the two longitudinal stretches 3', at a predetermined first pressure and exits at a predetermined second pressure, at least equal to the piezometric load exerted by the hydraulic head of the overlying fluid, through the plurality of the calibrated holes 6, in the lower part of the upper volume 4. Then, passing through the longitudinal slit or channel 9 defined by bulkheads 7, the fluid proceeds aligned and with no flitting along a vertical direction towards the piece to be treated, to then continue on the sides of the same, cooling them.

A continuous, on the average uniform upward flow is obtained with the structure of the tank of the invention, which laps the immersed rail head at a relative fluid-head surface rate such as to ensure a constant thermal exchange and thus make the thermal treatment of the same head uniform on the entire rail length.

The invention claimed is:

1. A cooling tank, defining a longitudinal axis, for a thermal treatment of a rail head by immersion, comprising a volume adapted to be filled with a cooling fluid in which the rail head to be thermally treated can be immersed, said volume having a bottom, wherein the bottom is provided with only one single row of nozzles, arranged along said longitudinal axis and parallel to a symmetry plane of said volume, whereby jets of cooling fluid can be generated in said volume, wherein there is provided at least one pair of substantially reciprocally parallel longitudinal bulkheads, arranged in said volume substantially perpendicular to said bottom and symmetrically with respect to said single row of nozzles, configured to direct upwards and towards a center of the rail head said jets of cooling fluid, wherein adjustment means are provided in order to adjust a position of the longitudinal bulkheads in a vertical direction and/or to adjust a distance L between the two longitudinal bulkheads of said at least one pair, and wherein said, adjustment means for adjusting the position of the longitudinal bulkheads in a vertical direction comprise a plurality of flat support elements, each flat support element being arranged orthogonal to the longitudinal bulkheads and provided with two slits having a shape complementary to a shape of at least a part of a transversal section of the longitudinal bulkheads; and said longitudinal bulkheads are inserted in said slits of the flat support elements.

2. A cooling tank according to claim 1, wherein the longitudinal bulkheads and the single row of nozzles extend along the entire longitudinal extension of the tank.

3. A cooling tank according to claim 1, wherein the longitudinal bulkheads rest on the bottom.

4. A cooling tank according to claim 1, wherein the longitudinal bulkheads are distanced from the bottom.

5. A cooling tank according to claim 1, wherein a distance L between the longitudinal bulkheads is comprised in a range $d \leq L \leq 2d$, where d is a diameter of the nozzles.

6. A cool tank according to claim 4, wherein a distance G between the longitudinal bulkheads and the bottom is comprised in a range $0 < G \leq 1.5L$, where L is a distance between the longitudinal bulkheads.

7. A cooling tank according to claim 1, wherein a height H of the longitudinal bulkheads is equal to $H \geq 2L$, where L is a distance between the longitudinal bulkheads.

8. A cooling tank according to claim 7, wherein the height H of the longitudinal bulkheads is equal to four or five times the distance L between the longitudinal bulkheads.

9. A cooling tank according to claim 1, comprising two or more longitudinal modules connected in succession to each other at ends thereof so as to define said volume.

10. A cooling tank according to claim 1, comprising a further volume, arranged under the volume and communicating therewith by means of said single row of nozzles.

11. A cooling tank according to claim 10, wherein there are provided one or more delivery manifolds, for an introduction of the cooling fluid into said further volume, provided with a bifurcation with two longitudinal stretches parallel to said symmetry plane, whereby the cooling fluid introduced into said further volume passes through the single row of nozzles into the volume.

12. A cooling tank according to claim 4, wherein lower ends of said bulkheads are chamfered or comprise an end stretch bent outwards, inclined by an angle other than zero with respect to a bulkhead body and to the symmetry plane of the volume.

13. A cooling tank according to claim 1, wherein the longitudinal bulkheads have a rectangular transversal section and a closed inner end of the slits is obtained at a distance equal to a distance G from a first base surface of the flat support elements, and wherein an open outer end of the slits is provided at a same height as one or more second base surfaces of the flat support elements, parallel to said first base surface.

14. A cooling tank according to claim 1, wherein the longitudinal bulkheads have a body having a rectangular transversal section and an end stretch bent outwards with respect to said body, inclined by an angle other than zero with respect to said body and to the symmetry plane of the volume, and wherein the longitudinal bulkheads are provided with a plurality of slits, obtained at the two slits provided in each of the flat support elements.

15. A cooling tank according to claim 14, wherein a closed inner end of the slits is made at a first distance from a first base surface of the support elements, and a first end of the longitudinal bulkheads, totally inserted into the slits, is at a second distance, shorter than said first distance, from the first base surface.

16. A cooling tank according to claim 13, wherein said distance is comprised in the range $0<G\leq1.5L$, where L is the distance between the longitudinal bulkheads.

17. A cooling tank according to claim 15, wherein said second distance is comprised in the range $0<G\leq1.5L$, where L is the distance between the longitudinal bulkheads.

18. A cooling tank according to claim 6, wherein lower ends of said longitudinal bulkheads are chamfered or comprise an end stretch bent outwards, inclined by an angle other than zero with respect to a bulkhead body and to the symmetry plane of the volume.

* * * * *